US006693655B2

(12) United States Patent
Fujimoto et al.

(10) Patent No.: US 6,693,655 B2
(45) Date of Patent: Feb. 17, 2004

(54) PRINTING APPARATUS AND PRINTING METHOD

(75) Inventors: Toshiro Fujimoto, Nakakoma-gun (JP); Satoshi Kanemaru, Nakakoma-gun (JP)

(73) Assignee: Nisca Corporation, Yamanashi-ken ( * ) Notice: Subject to any disclaimer, the term of this patent is extended or adjusted under 35 U.S.C. 154(b) by 0 days.

(21) Appl. No.: 10/207,795

(22) Filed: Jul. 31, 2002

(65) Prior Publication Data

US 2003/0025780 A1 Feb. 6, 2003

(30) Foreign Application Priority Data

Aug. 3, 2001 (JP) ..... 2001-235790

(51) Int. Cl.[7] ..... B41J 2/32; B41J 2/325
(52) U.S. Cl. ..... 347/213; 400/120.01
(58) Field of Search ..... 347/171, 213; 400/120.01

(56) References Cited

U.S. PATENT DOCUMENTS

2003/0026635 A1 * 2/2003 Tsuruta et al. ..... 400/120.01

FOREIGN PATENT DOCUMENTS

| | | |
|---|---|---|
| JP | 08-058125 A | 3/1996 |
| JP | 08-332742 A | 12/1996 |
| JP | 09-131930 A | 5/1997 |

* cited by examiner

*Primary Examiner*—Huan Huu Tran
(74) *Attorney, Agent, or Firm*—Nixon Peabody, LLP

(57) ABSTRACT

A printing apparatus which can perform switching between a direct transfer system and an indirect transfer system, and which has reduced malfunction in print process, is provided. In the printing apparatus, determination is made whether a light emitting device detects the intermediate transfer sheet (S124), when the determination is affirmative, the touch panel is controlled to refuse accepting an input of a direct transfer mode (S128) and power supply for pulse motors which are driving sources for the direct transfer mode is stopped to make the first mode disable (S130). When the determination is negative, the touch panel is controlled to refuse accepting an input of an indirect transfer mode (S136) and power supply for pulse motors which are driving sources for the indirect transfer mode is stopped to make the indirect transfer mode disable (S138). When one mode is set, another mode is made disable.

13 Claims, 8 Drawing Sheets

PRINTING APPARATUS AND PRINTING METHOD

BACKGROUND OF THE INVENTION

1. Field of the Invention

The present invention relates to a printing apparatus and printing method for printing various information such as images and characters to a recording medium, such as a card, and more particularly to a printing apparatus and printing method which is capable of switching printing systems according to presence/absence of an intermediate transfer medium which temporarily saves the various information to print the various information.

2. Description of the Related Art

Conventionally, printing apparatuses of a thermal transfer system which effects thermal transfer on a recording medium by a thermal head via a thermal transfer film to record desired images and characters thereon are used for producing card-shaped recording media such as credit cards, cash cards, license cards, ID cards and the like. As one example, Japanese Patent Application Laid-Open No. 09-131930 (JP-A) disclosed a printing apparatus of a direct transfer system which directly transfers images, characters and the like on a recording medium via a thermal transfer film. This system has such an advantage that high quality images can be obtained because use of thermal sublimate ink is superior in gradation expression due to ink characteristics. However, since it is essential to provide a receptive layer for receiving the ink on a surface of a recording medium to which images or the like should be transferred, it is necessary to limit the type of a recording medium to be used or to form the receptive layer on a surface of the recording medium.

Generally, cards made of polyvinyl chloride (also known as PVC cards) are widely used as the recording medium because they can receive thermal sublimate ink. However, due to the fact that harmful substances are generated when these cards are burnt, consideration has been given to switching to cards made of polyethylene terephthalate (also known as PET cards).

Furthermore, in recent years, in card-like recording media where an IC chip and an antenna have been embedded, such as IC cards, which are being used in various fields, since undulations are formed on surfaces of the media due to the elements embedded therein, such a drawback is indicated that it becomes difficult to perform image transfers on the undulated surfaces of the media.

As a printing apparatus of a thermal transfer type for solving the above drawback, JP-A 08-332742 discloses a technique of a printing apparatus of a so-called indirect transfer system where, after an image has been once transferred on an intermediate transfer medium, this image is transferred to a medium to be transferred or a recording medium. According to this system, it is possible to overcome such problems as the limitation of the type of recording media to be used regarding the receptive layer, the drawback at the time of image transfer to the undulated face of the recording medium, or the like. Furthermore, in this system, there is an advantage such that the entire surface of a card-shaped recording medium can be performed more easily than the direct transfer system.

However, in the intermediate transfer system, there is a drawback in that running costs therefor become higher than those that in the direct transfer system and processing time required for printing becomes longer, because it is necessary to use the intermediate transfer medium in the intermediate transfer system. Depending on the design of a card, there are many cases that a surface of a card must be printed over the entire surface but only a precaution for card use or the like is printed on a back surface thereof, thus there are fewer cases requiring printing over both the entire surfaces by the intermediate transfer system. Therefore, there are advantages and disadvantages in the two printing systems. Accordingly, when a printing apparatus which can perform switching between the direct transfer system and the indirect transfer system according to a printing object to print an image or the like on a recording medium can be obtained, running costs according to printing can be reduced. Therefore, it is considered that such printing apparatuses will be widely used in the future.

However, when printing process is performed in a printing apparatus compatible with both the systems, because its print processing aspect becomes complex, it is anticipated that drawbacks such as processing errors will increase according to an increase in malfunctions in print processing.

SUMMARY OF THE INVENTION

In view of the above circumstances, an object of the present invention is to provide a printing apparatus and printing method which can perform switching between a direct transfer system and an indirect transfer system and which has reduced malfunction in print process.

In order to solve the above problem, according to a first aspect of the present invention, there is provided a printing apparatus, comprising: at least one printing unit which selectively forms an image on a recording medium and an intermediate transfer medium which temporarily saves an image thereon; a transfer unit which transfers the image formed on the intermediate transfer medium to the recording medium; an intermediate transfer medium detecting unit which detects the intermediate transfer medium; a mode setting unit which sets one of a first mode for forming an image on the recording medium by the printing unit and a second mode for forming an image on the intermediate transfer medium; and a mode control unit which causes the printing unit to perform image forming in one of the first and second modes set by the mode setting unit, wherein the mode control unit inhibits execution of image forming in the first mode when the intermediate transfer medium detecting unit detects the intermediate transfer medium.

In this aspect, when the first mode for forming an image on the recording medium is set by the mode setting unit, an image is formed on the recording medium by the printing unit. On the other hand, when the second mode for forming an image on the intermediate transfer medium which temporarily saves an image thereon is set, an image is formed on the intermediate transfer medium by the printing unit, and the image formed on the intermediate transfer medium by the printing unit is transferred on the recording medium by the transfer unit. Such a control of image forming effected by the printing unit is performed by the mode control unit, and the mode control units inhibits execution of image forming in the first mode, when the intermediate transfer medium detecting unit detects the intermediate transfer medium. According to this aspect, since an image is formed on the recording medium by the printing unit in response to the mode set by the mode setting unit and an image formed on the intermediate transfer medium by the printing unit is transferred on the recording medium by the transfer unit, it is possible to perform switching between the direct transfer system and the indirect transfer system to perform printing at a time of printing to a recording medium, and the mode control unit inhibits execution of image forming in the first mode, namely image forming to the recording medium performed by the printing unit, when the intermediate transfer medium detecting unit detects the intermediate transfer medium. Therefore, since the first mode is disabled when the second mode has been set, the drawback due to print processing can be reduced and the capacity or ability of print processing can be improved.

As such an inhibiting aspect, for example, there are various aspects such that (1) the printing unit has printing elements for forming an image on the recording medium or the intermediate transfer medium in response to print information transmitted from the mode control unit, and the mode control unit inhibits feeding of print information in the first mode to the print elements when the intermediate transfer medium detecting unit detects the intermediate transfer medium; (2) in case that a recording medium transporting unit which reciprocates the recording medium relative to the printing unit and a recording medium transport driving unit which drives the recording medium transporting unit are further provided, the mode control unit inhibits driving of the recording medium transport driving unit when the intermediate transfer medium detecting unit detects the intermediate transfer medium, (3) the mode control unit causes the mode setting unit to refuse acceptance of the first mode when the intermediate transfer medium detecting unit detects the intermediate transfer medium, and so on.

According to a second aspect of the invention, there is provided a printing apparatus, comprising: at least one printing unit which selectively forms an image on a recording medium and an intermediate transfer medium which temporarily saves an image thereon; a transfer unit which transfers the image formed on the intermediate transfer medium to the recording medium; an intermediate transfer medium detecting unit which detects the intermediate transfer medium; a mode setting unit which sets one of a first mode for forming an image on the recording medium by the printing unit and a second mode for forming an image on the intermediate transfer medium; and a mode control unit which causes the printing unit to perform image forming in one of the first and second modes set by the mode setting unit, wherein the mode control unit inhibits execution of image forming in the second mode at a time of non-detection of the intermediate transfer medium by the intermediate transfer medium detecting unit.

According to this aspect, like the first aspect, since an image is formed on the recording medium by the printing unit in response to the mode set by the mode setting unit and an image formed on the intermediate transfer medium by the printing unit is transferred on the recording medium by the transfer unit, it is possible to perform switching between the direct transfer system and the indirect transfer system to perform printing, and the mode control unit inhibits execution of image forming effected in the second mode, namely, image forming to the intermediate medium effected by the printing unit, when the intermediate transfer medium detecting unit does not detect the intermediate transfer medium. Therefore, since the second mode is disabled when the first mode has been set, the drawback due to print processing can be reduced and the capacity of print processing can be improved.

As such an inhibiting aspect, there are various aspects such that, for example, (1) the printing unit has printing elements for forming an image on the recording medium or the intermediate transfer medium in response to print information transmitted from the mode control unit and when the intermediate transfer medium detecting unit does not detect the intermediate transfer medium, the mode control unit inhibits transmission of print information in the second mode to the printing elements; (2) the mode control unit causes the mode setting unit to refuse acceptance of the second mode when the intermediate transfer medium detecting unit does not detect the intermediate transfer medium, and so on.

In the first and second aspects, as the type of the intermediate transfer medium detecting unit, (1) a transmission type sensor which is disposed in a transporting path of the intermediate transfer medium or (2) an intermediate transfer medium supply spool rotation detecting sensor which, when an intermediate transfer medium supply spool on which an unused portion of the intermediate transfer medium is wound is further provided, detects rotation of the intermediate transfer medium supply spool may be listed.

Further, according to a third aspect, there is provided a printing method comprising the steps of: transporting a recording medium and an intermediate transfer medium which temporarily saves an image to an image forming position; selectively forming an image on the recording medium or on the intermediate transfer medium in the image forming position; transporting one of the same as the recording medium and a different recording medium to an image transferring position; and transferring an image formed on the intermediate transfer medium in the image transferring position to the recording medium, wherein image forming to either one of the recording medium and the intermediate transfer medium is inhibited in response to a detection signal for detecting the intermediate transfer medium. According to a fourth aspect of the invention, there is provided a printing method comprising the steps of: transporting a recording medium and an intermediate transfer medium which temporarily saves an image to an image forming position; selectively forming an image on the recording medium or on the intermediate transfer medium in the image forming position; transporting one of the same as the recording medium and a different recording medium to an image transferring position; and transferring an image formed on the intermediate transfer medium in the image transferring position to the recording medium, wherein transport of the recording medium to the image forming position is inhibited in response to a detection signal for detecting the intermediate transfer medium.

DETAILED DESCRIPTION OF THE PREFERRED EMBODIMENTS

Embodiments of a printing apparatus to which the present invention has been applied will be explained below with reference to the drawings.

(Constituent)

Figure 1:
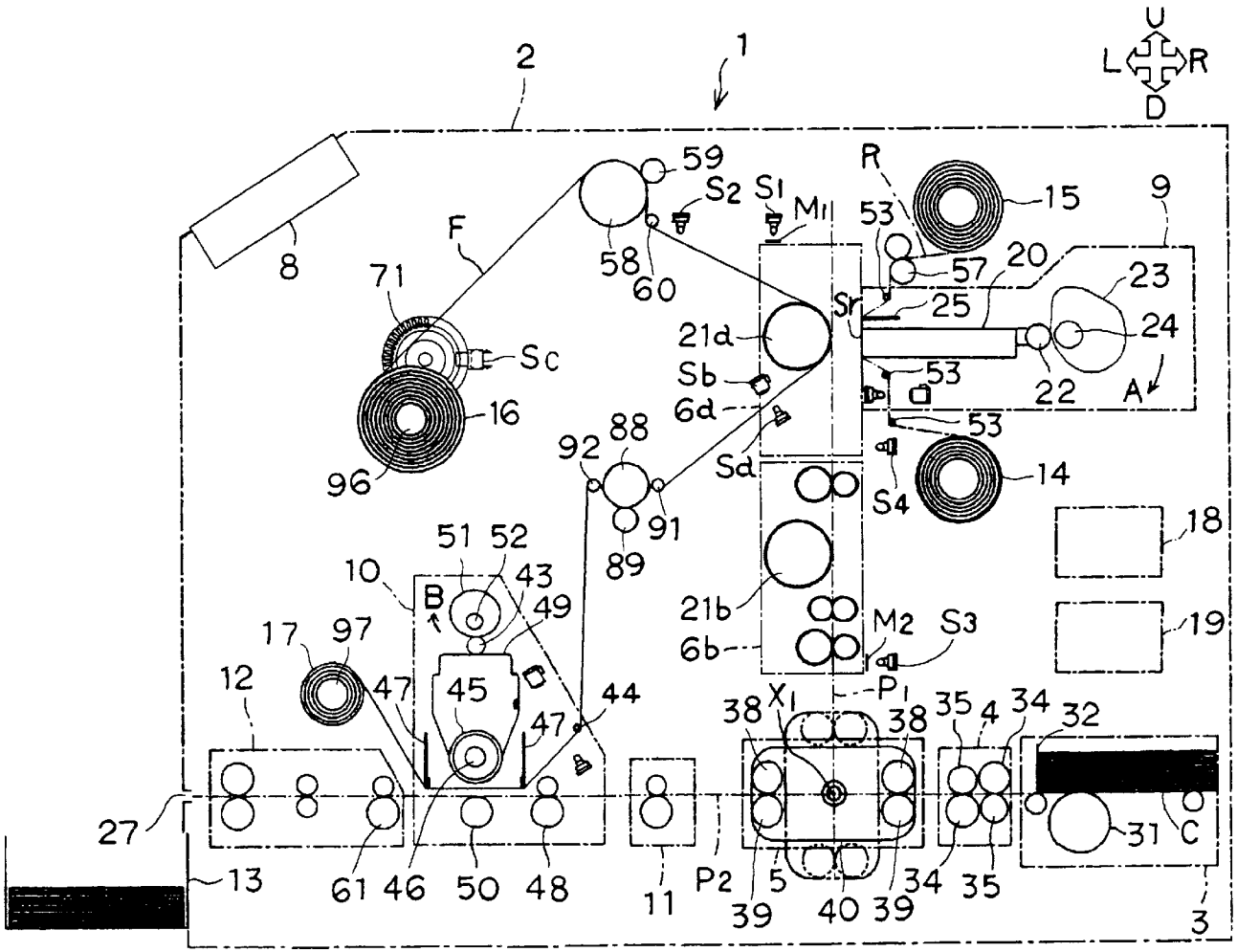
FIG. 1 is a front view showing a schematic configuration of a printing apparatus of an embodiment to which the present invention is applicable.

As shown in FIG. 1, a printing apparatus according to the embodiment comprises, in a casing 2 which is a housing, a first card transport path P1 which is a transport path for forming or printing an image on a card C which is a recording medium by a direct transfer system and a second card transport path P2 which is a card transport path for transferring to the card C an image which has been temporarily saved on an intermediate transfer sheet F which is an intermediate transfer medium by an indirect transfer system. The second card transport path P2 is disposed generally horizontally, while the first card transport path P1 is disposed generally vertically. The first card transport path P1 and the second transport path P2 intersect generally orthogonally at an intersecting point X1.

A card supply portion 3 which separates stacked blank cards C to send them to the second card transport path P2 one by one, a cleaner 4 which cleans a surface of the blank card C downstream of the card supply portion 3, and a turning portion 5 which can rotate or invert the card C while nipped, rotating around the intersecting point X1 downstream of the cleaner 4, to orthogonally switch the transport path of the card C in the direction of the first card transport path P1 are respectively arranged in the second card transport path P2.

The card supply portion 3 has a card stacker which stores a plurality of cards C in a stack. A stacker side plate 32 having a opening slot which allows passing of only one card C is disposed at a portion of the stacker facing the second card transport path P2, and a kick roller 31 which rotate to feed the bottommost card C of a plurality of the blank cards stored in a stack in the card stacker to the second card transport path P2 is arranged so as to come into pressure-contact with the bottommost card C.

The cleaner 4 comprises a cleaning roller 34, which is made of rubber material and whose surface is applied with adhesive substance or the like, and a pressing roller 35 brought in pressure-contact with the cleaning roller 34, these rollers constituting a pair through the second card transport path P2.

The turning portion 5 comprises paired pinch rollers 38 and 39 which are capable of nipping the card C, and a rotating flame 40 which rotatably supports these pinch rollers, and rotates and reverses about the intersecting point X1. One of these pinch rollers 38 and 39 is a drive roller and the other thereof is an idle roller. The pinch rollers 38 and 39 in a horizontal state are brought in pressure-contact with each other through the second card transport path P2 (shown with a solid line in FIG. 1), and they in a vertical state are brought in pressure contact with each other through the first card transport path P1 (shown with a double dotted line in FIG. 1). When the rotating flame 40 is rotated and reversed in a state where the card C is nipped between the pinch rollers 38 and 39, the pinch rollers 38 and 39 are also rotated to displace the card C, so that the rotating and reversing operations of the turning portion 5 are performed independent of the rotation of the rotating flame 40 and the rotations of the pinch rollers 38 and 39.

Incidentally, a unitized type transmission sensor (combined with a slit plate) (not shown) which detects a rotation angle of the rotating flame 40 is disposed in the vicinity of the turning portion 5. Also, in order to judge the rotation direction of the pinch rollers 38 and 39, a unitized type transmission sensor (combined with a half-moon plate) (not shown) which detects the position of either one of the pinch rollers 38 and 39 is disposed, so that the rotation angel of the rotating flame 40 can arbitrarily be set and the transport direction of the card C performed by the pinch rollers 38 and 39 can be controlled.

Also, the printing apparatus 1 comprises a carrier 6*b* which has a platen roller 21*b* and which is movable (can advance and retract) between an image forming position and a retracted position in a direction of arrow U or in a direction of arrow D (Y direction), described later, a carrier 6*a* which has a platen roller 21*a* and is movable between an image forming position and a retracted position in a direction of arrow L or in a direction of arrow R (X direction), described later, and an image forming portion 9 which has a thermal head 20 and which is a printing unit and which heats a thermal transfer sheet R to form an image on the card C or an intermediate transfer sheet described later in accordance with regular image data or mirror image data).

Figure 8A:
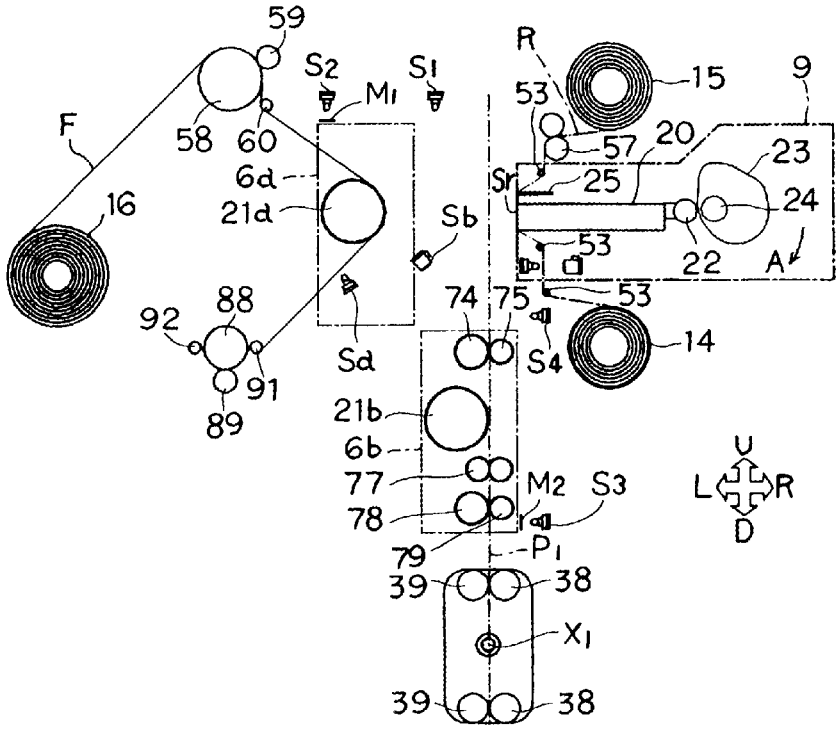
FIGS. 8A and 8B are front views of a portion of the printing apparatus of the embodiment which is in the vicinity of a first card transporting path, FIG. 8A showing a state where carriers 6*a* and 6*b* are positioned in retracted positions and FIG. 8B showing a state where the carrier 6*a* is positioned in the retracted position and a leading edge of a card is positioned at an image forming position through transport of the card after the carrier 6*b* has been positioned in an image forming position.

As shown in FIG. 1, the carrier 6*a* is positioned in the image forming position in a state where a peripheral portion of the platen roller 21*a* comes in contact with the first card transport path P1, and it is positioned in the retracted position in a state where it has been separated from the first card transport path P1, as shown in FIG. 8A. Detection is made by unitized type reflection sensors S1 and S2 about whether the carrier 6*a* is positioned in the image forming position or in the retracted position. The unitized type reflection sensor S1 and S2 emit light towards a mirror M1 fixed to the carrier 6*a* and receives reflected light from the mirror to output a high level signal. A rack rail extending in the X direction is fixed to the carrier 6*a* on the depth side of the drawing. A pinion gear meshes with the rack rail, and rotational drive is transmitted to the pinion gear from a pulse motor PM2 so that movement of the carrier 6*a* is performed between the image forming position and the retracted position. Furthermore, the platen roller 21*a* can rotate in a clockwise direction or in a counterclockwise direction according to rotational drive from the pulse motor PM3 which is movable together with the carrier 6*a*.

Also, the carrier 6*a* has a light emitting element Sa which is disposed on the depth side of the drawing of FIG. 1 and which emits light obliquely and upwardly. When the carrier 6*a* is positioned in the image forming position, light emitted from the light emitting element Sa is received through the intermediate transfer sheet F by a light receiving element Sb which is a transmission sensor which is disposed on the depth side of the drawing of FIG. 1 so as not to block movement of the intermediate transfer sheet F moved between the image forming position and the retracted position so that existence of the intermediate transfer sheet F can be detected. On the other hand, as shown in FIG. 8A, when the carrier 6*a* is moved in the retracted position, the light emitting element Sa is also moved together with the carrier 6*a*. Therefore, the a positional relationship between the light emitting element Sa and the light receiving element Sb disposed at a fixed position is changed so that existence of the intermediate transfer sheet F can not be detected.

Figure 8B:
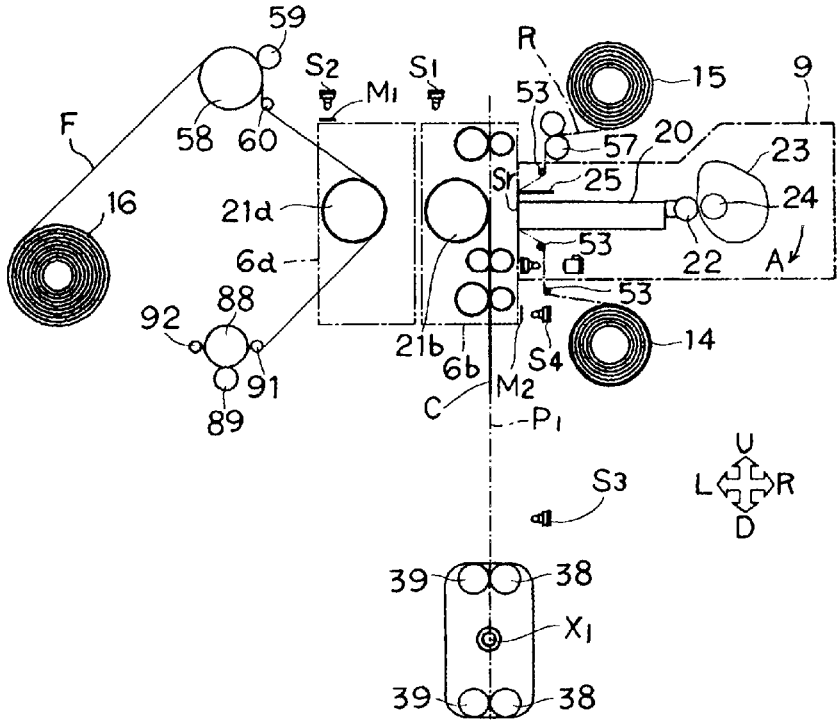
Figure 9A:
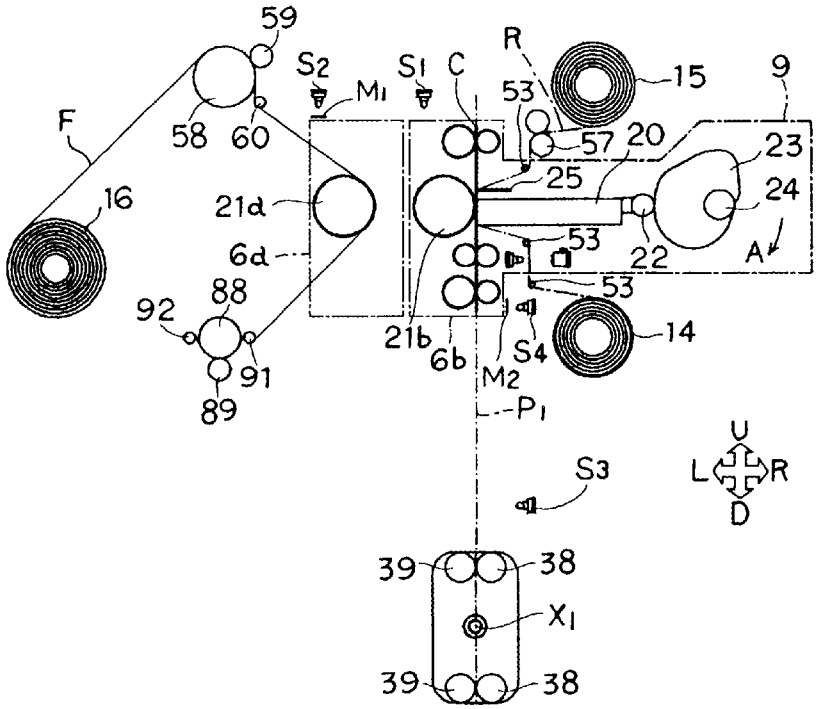
FIGS. 9A and 9B are front views of the portion of the printing of the printing apparatus of the embodiment which is in the vicinity of the first card transporting path, FIG. 9A showing a state where image forming is being performed on a card in an image forming portion and FIG. 9B showing a state where image forming is being performed on an intermediate transfer sheet in the image forming portion.
Figure 9B:
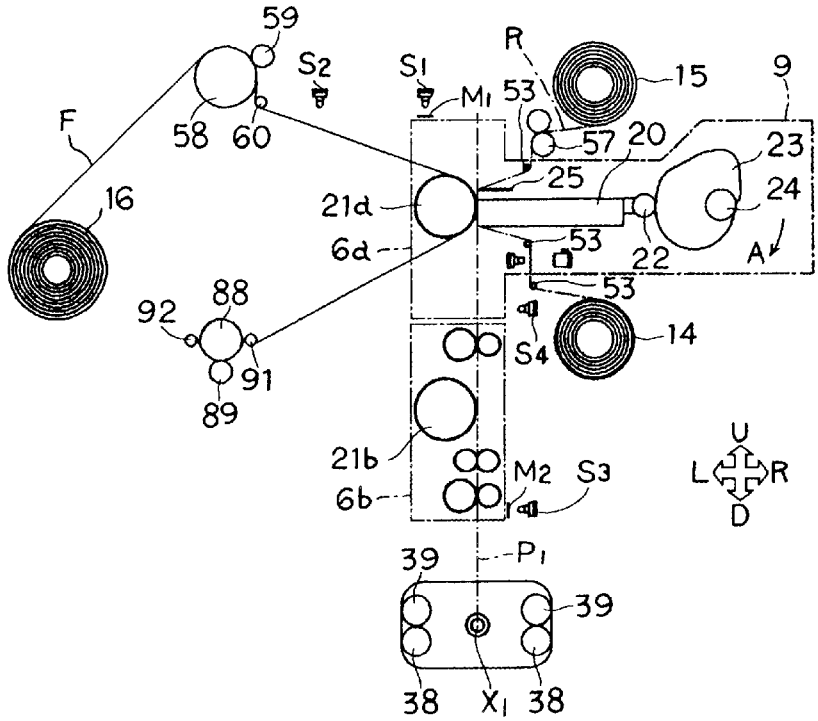

On the other hand, as shown in FIG. 1 and FIG. 8A, the carrier 6*b* is positioned in the retracted position in a state where the platen roller 21*b* has been separated from the image forming portion 9, and it is positioned in the image forming position in a state where the platen roller 21*b* has been opposed to the thermal head 20, as shown in FIG. 8B. Detection is made by unitized type reflection sensors S3 and S4 about whether the carrier 6*ba* is positioned in the retracted position or in the image forming position. The unitized type reflection sensors S3 and S4 emit light to a mirror M2 fixed to the carrier 6*b* and receives light reflected from the mirror M2 to output a high level signal. A rack rail extending in parallel with the first card transport path P1 is disposed on the front side of the drawing of FIG. 1. A pinion gear meshes with the rack rail and rotational drive is transmitted to the pinion gear from a pulse motor PM4 so that movement of the carrier 6*b* between the image forming position and the retracted position is performed. Incidentally, when the carrier 6*a* is positioned in the image forming position, the carrier 6*b* is positioned in the retracted position, and when the carrier 6*b* is positioned in the image forming position, the carrier 6*a* is positioned in the retracted position.

Also, as shown in FIG. 8A, the carrier 6*b* comprises an upper roller pair constituted with a capstan roller 74 having a constant rotation speed and a pinch roller 75 brought into pressure-contact with the capstan roller 74 through the first card transport path P1, a lower roller pair constituted with a capstan roller 78 and a pinch roller 79 brought into pressure-contact with the capstan roller 78 via the first card transport path P1, and a roller pair having no drive, which is disposed between the platen roller 21*b* and the lower roller pair via the first card transport path P1. The platen roller 21*b* can be rotated by rotational drive from a pulse motor PM5 in a clockwise direction or in a counterclockwise direction, and simultaneously the rotational drive from the pulse motor PM5 is transmitted to the capstan rollers 74 and 78 via a plurality of gears (not shown). For this reason, when the platen roller 21*b* is rotated in the clockwise direction or in the counterclockwise direction, the capstan rollers 74 and 78 are also rotated in the clockwise direction or in the counterclockwise direction in synchronism with the platen roller 21*b*.

The image forming portion 9 employs a constitution of a thermal transfer printer, and it includes a thermal head 20 arranged so as to advance to and retract from the platen roller 21*a* or 21*b*. many heating elements for heating the thermal transfer sheet R are arranged in a matrix in the thermal head 20. As shown in FIGS. 1, 8A and 8B, and 9A and 9B, advancing and retracting movements of the thermal head 20 relative to the platen rollers 21*a* and 21*b* are performed by an advancing and retracting drive unit comprising a holder (not shown) holding the thermal head 20 attachably/detachably, an idle roller 22 fixed to the holder, a thermal head advancing and retracting non-circular cam 23 which rotates about a cam shaft 24 in either direction (in the direction of arrow A or in the direction opposed thereto) while coming in contact with the periphery of the idle roller 22, and a spring (not shown) which brings the holder into pressure-contact with the thermal head advancing and retracting cam 23.

Figure 2:
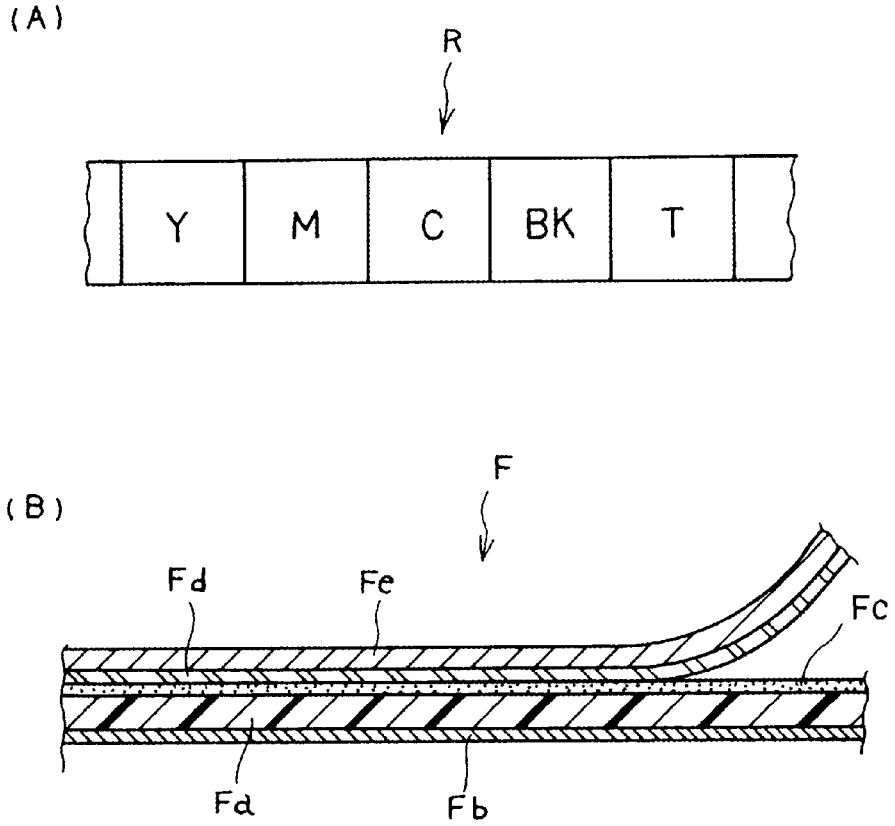
FIGS. 2A and 2B are explanatory diagram of a thermal transfer sheet and an intermediate transfer sheet, FIG. 2A being a front diagram schematically showing a thermal transfer sheet and FIG. 2B being a sectional diagram schematically showing an intermediate transfer sheet.

The thermal transfer sheet R is spanned over a distal end of the thermal head 20. As shown in FIG. 2A, the thermal transfer sheet R comprises, for example, a strip-shaped film which has a width slightly larger than the length of the card C and which is repeatedly affixed with inks of y (yellow), M (magenta), C (cyan) and Bk (black) in this order and subsequent thereto has a protection layer area T for protecting a surface of the card C on which an image has been formed. As shown in FIG. 1, the thermal transfer sheet R is supplied from a thermal transfer sheet supply portion 14 where the thermal transfer sheet R has been wound in a roll, it is guided by a plurality of rolls 53 and a guide plate 25 fixed to the above-described holder (not shown), and it is wound on a thermal transfer sheet take-up portion 15 which is driven together with rotational drive of a take-up roller pair 57 to take up the thermal transfer sheet R in a roll while a generally entire surface of the thermal transfer sheet R is being brought into contact with the distal end of the thermal head 20. The thermal transfer sheet supply portion 14 and the thermal transfer sheet take-up portion 15 are disposed on both sides of the thermal head 20, and their central portions are respectively fitted to spool shafts.

Also, a light emitting element and a light receiving element for detecting a mark for detecting the position of the thermal transfer sheet R or the Bk position of the thermal transfer sheet R are disposed in the image forming portion 9 between two guide rolls 53 arranged between the thermal transfer sheet supply portion 14 and the thermal head 20 so as to be separated from the thermal transfer sheet R orthogonally thereto. Incidentally, a gear (not shown) is fitted to a roller shaft on the drive side of the take-up roller pair 57 coaxially thereto, and the gear meshes with another gear having a clock plate (not shown) coaxially. Furthermore, an unitized type transmission sensor (not shown) for detecting rotation of the clock plate (not shown) is disposed in the vicinity of the clock plate (not shown) in order to manage the take-up amount of the thermal transfer sheet R.

As shown in FIGS. 1, 8A and 8B, and 9A and 9B, when the carriers 6*a* and 6*b* are positioned in the image forming positions, a printing position (heating position) Sr of the thermal head 20 to the intermediate transfer sheet described later or the card C corresponds to a peripheral portions of the platen rollers 21*a* and 21*b* coming in contact with the first card transport path P1, and a position where the printing position Sr of the thermal head 20 comes in contact with the platen roller 21*a* or the platen roller 21*b* via the thermal transfer sheet R and the card C or the intermediate transfer sheet F is an image forming position in a narrow sense.

The intermediate transfer sheet F is turned over a peripheral face of the platen roller 21*a* which is positioned on the side of the thermal head 20. As shown in FIG. 2B, the intermediate transfer sheet F is formed by stacking or laminating a base film Fa, a back face coat layer Fb formed on the formed on a back face of the base film Fa, a receptive layer Fe receiving ink, an overcoat layer Fd protecting a surface of the receptive layer Fe, and a peeling-off layer Fc formed on a surface of the base film Fa and facilitating integral peeling-off of the overcoat layer Fd and the receptive layer Fe from the base film Fa in the order of the back face coat layer Fb, the base film Fc, the overcoat layer Fd and the receptive layer Fe from the lower side. The intermediate transfer sheet F is spanned such that the receptive layer Fe is opposed to the thermal transfer sheet R and the back face coat layer abuts on the platen roller 21*a*.

Also, as shown in FIG. 1, in the printing apparatus 1, a horizontally transporting roller pair 11 which transports the card C horizontally, a transfer portion 10 serving as a transfer unit, which transfers an image formed on the intermediate transfer sheet F by the image forming portion 9, and a horizontally transporting portion 12 with a plurality of transport roller pairs, which transports the card C horizontally and has a discharge roller pair for discharging the card C outside are arranged on the second card transport path P2 in this order on a downstream side (arrow L side) of the turning portion 5. These roller pairs arranged on the second card transport path P2 are driven by a pulse motor PM6 (not shown) via a plurality of gears.

Figure 3:
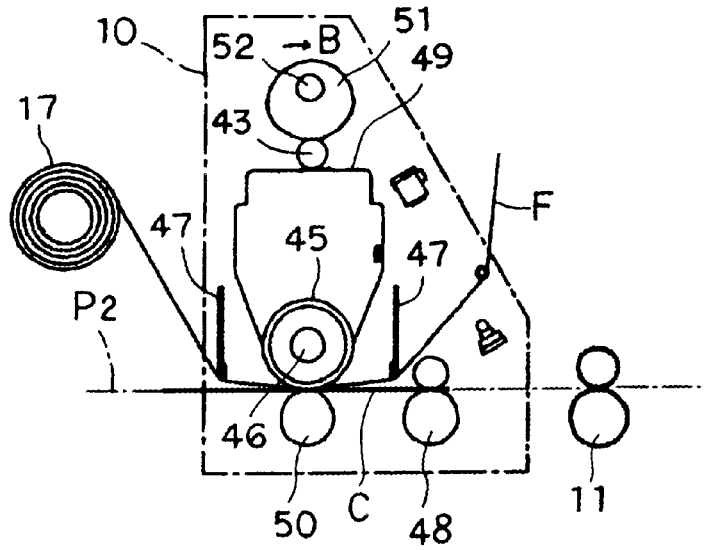
FIG. 3 is a front view of a transfer portion of the printing apparatus of the embodiment, which shows a state where image forming to a card is performed by an intermediate transfer sheet.

The transfer portion 10 comprises a platen roller 50 which supports the card c at a transfer time of the intermediate transfer sheet F to the card C and a heat roller 45 which is arranged so as to advance to and retract from the platen roller 50. A heat generating lamp 46 for heating the intermediate transfer sheet F is built in the heat roller 45. The intermediate transfer sheet F is interposed between the platen roller 50 and the heat roller 45. As shown in FIGS. 1 and 3, advancing and retracting movement of the heart roller 45 to the platen roller 50 is performed by an ascending/descending drive unit comprising a holder 49 which attachably/detachably holds the heat roller 45, an idle roller 43 rotatably supported to the holder 49, a non-circular heat roller ascending/descending cam 51 which rotates in one direction (arrow B direction) about a cam shaft 52 while contacting the periphery of the idle roller 43, and a spring (not shown) which brings an upper face of the holder 49 into pressure-contact with the heat roller ascending/descending cam 51.

As shown in FIG. 1, the intermediate transfer sheet F is supplied from an intermediate transfer sheet supply portion 16 on which an unused portion of the intermediate transfer sheet F is wound in a roll, it is guided by a transport roller 58 accompanying an idle roller 59, a guide roll 60 and the platen roller 21*a*, a guide roll 91, a back tension roller 88 imparting a back tension to the intermediate transfer sheet F in cooperation with a pinch roller 89, a guide roll 92, a guide roll 44, and guide plates 47 disposed on both sides of the heat roller 45 and constituting the transfer portion 10, it is nipped between the platen roller 50 and the heat roller 45 via the card C on the second card transport path P2 at the transfer time (refer to FIG. 3), and it is wound on an intermediate transfer sheet take-up portion 17 which takes up the intermediate transfer sheet Fin a roll. Also, a transport roller pair 48 which is put in a pressure contacting state through the second card transport path P2 and which can transport the card C in a direction of arrow L shown in FIG. 1 together with a transport roller pair 61 which is disposed within the horizontal transport portion 12 and has a capstan roller as a drive roller is disposed in the transfer portion 10 downstream of the horizontally transporting roller pair 11 and upstream of the platen roller 50. Incidentally, a light emitting element and a light receiving element for detecting a mark for positioning the intermediate transfer sheet F are arranged so as to be opposed to each other through the intermediate transfer sheet F between the guide roll 44 and the guide plate 47 in the transfer portion 10.

A pulse motor PM 1 which rotates and inverts an intermediate transfer sheet supplying spool 96 to which the intermediate transfer sheet supply portion 16 is loaded and an intermediate transfer sheet take-up spool 97 to which the intermediate transfer sheet take-up portion 17 is loaded to transport (forward and backward feed) the intermediate transfer sheet F is disposed via a plurality of gears (not shown) in a region defined by the casing 2, the first card transport path P1 and the second card transport path P2, which are shown in FIG. 1. A gear (not shown) is fitted on the intermediate transfer sheet supplying spool 96, and a clock plate 71 is fitted to a shaft of a gear meshing with the gear. A unitized type transmission sensor Sc which detects presence/absence of the intermediate transfer sheet F by detecting the amount of rotation of the intermediate transfer sheet supplying spool 96 via rotation of the clock plate 71 is disposed in the vicinity of the clock plate 71. Similarly, a clock plate and a unitized type transmission sensor (not shown) are disposed on the side of the intermediate transfer sheet take-up spool 97. A rotational drive force from the pulse motor PM1 is transmitted to the back tension roller 88 brought into pressure-contact with the pinch roller 89 via a torque limiter. A clock plate is fitted to the back tension roller 88 coaxially, and the back tension roller 88 rotates in synchronism with the intermediate transfer sheet F when the intermediate transfer sheet F is fed forward and backward. A unitized type transmission sensor (not shown) which detects the amount of rotation of a clock plate for managing the feed amount of the intermediate transfer sheet F is disposed in the vicinity of the clock plate. Incidentally, for torque management of the intermediate transfer sheet F, a relationship of the platen roller 21*a*>the transport roller 58>the intermediate transfer sheet supplying spool 96 is set.

As shown in FIG. 1, a discharge port 27 which discharges the cards C which have been subjected to such a processing as printing outside the housing 2 is formed on an extension line of the second card transport path P2 along the direction of arrow L in the housing 2. A stacker 13 which stocks the cards C in a stack is attachably/detachably mounted to the housing 2 on the lower side of the discharge port 27. Incidentally, a unitized type transmission sensor S5 is disposed between the cleaner 4 and the turning portion 5, a unitized type transmission sensor S6 is disposed between the turning portion 5 and the carrier 6*a* (retracted position), a unitized type transmission sensor S7 is disposed in the vicinity of the transport roller pair 48 on the side of the horizontally transporting roller pair 11, a unitized type transmission sensor S8 is disposed in the vicinity of a roller pair which does not have any drive and is disposed between the transport roller pair 61 and the discharge roller pair in the horizontal transport portion 12 on the side of the discharge roller pair 11, and a unitized type transmission sensor S9 is disposed between the horizontal transport portion 12 and the discharge port 12, respectively (not shown), so that a leading edge or a trailing edge of the card C transported along the first card transport path P1 or the second card transport path P2.

As shown in FIG. 1, the printing apparatus 1 comprises a power supply portion 18 which converts commercial ac power supply to a dc power supply which can drive/operate various mechanical portions, control portions and the like and a control portion 19 which performs operation control on the entire printing apparatus 1, which are disposed in the housing 2, and a touch panel 8 serving as a mode set unit, which displays the status of the printing apparatus 1 or the like according to information from the control portion 19 and can issue operation commands to the control portion 19 according to operation of an operator and which is provided on an upper portion of the housing 2.

Figure 4:
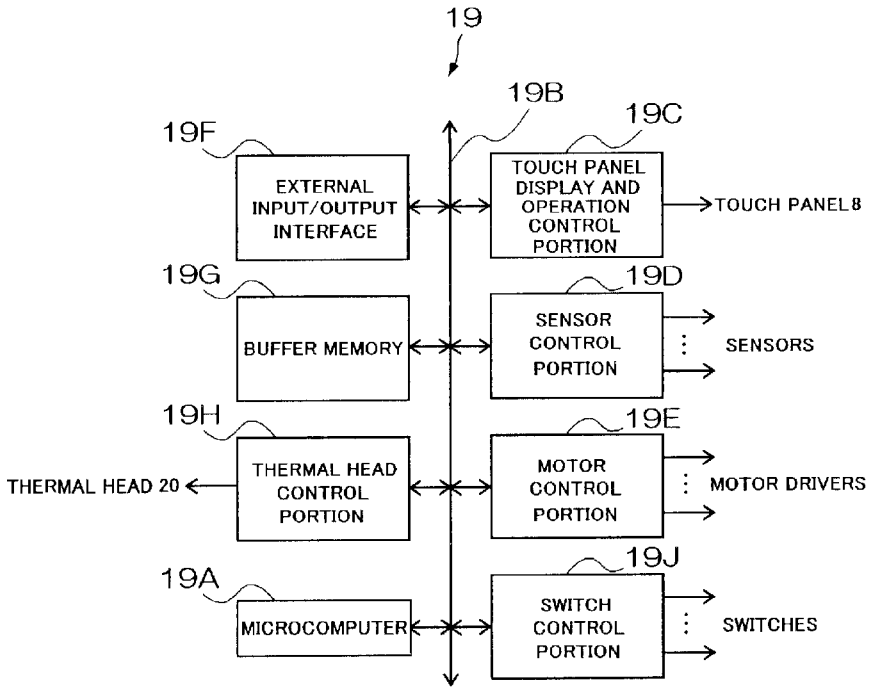
FIG. 4 is a block diagram showing a schematic configuration of a control portion of the printing apparatus of the embodiment.

As shown in FIG. 4, the control portion 19 has a microcomputer 19A which performs control processing of the printing apparatus 1. The microcomputer 19A is constituted with a CPU which serves as a central processing unit operating with high speed clocks, a ROM in which control operation of the printing apparatus 1 has been stored, a RAM which works as a work area for the CPU, and an internal bus connecting these members.

An external bus 19B is connected to the microcomputer 19A. a touch panel display and operation control portion 19C which controls display and operation instructions of the touch panel 8, a sensor control portion 19D which controls signals from various sensors, a motor control portion 19E which controls motor drivers feeding drive pulses to respective motors, an external input/output interface 19F which performs communication between an external computer and the printing apparatus 1, a buffer memory 19G which temporarily stores image information to be printed on the card C or the like therein, a thermal head control portion 19H which controls thermal energy of the thermal head 20, and a switch control portion 19J which controls switches for turning on/off power to predetermined motor drivers from the power supply portion 18 are connected to the external bus 19B. the touch panel display and operation control portion 19C, the sensor control portion 19D, and the thermal head control portion 19H are respectively connected to the touch panel 8, sensors including the sensors Sa, Sb, Sc and the like, and the thermal head 20.

Figure 5:
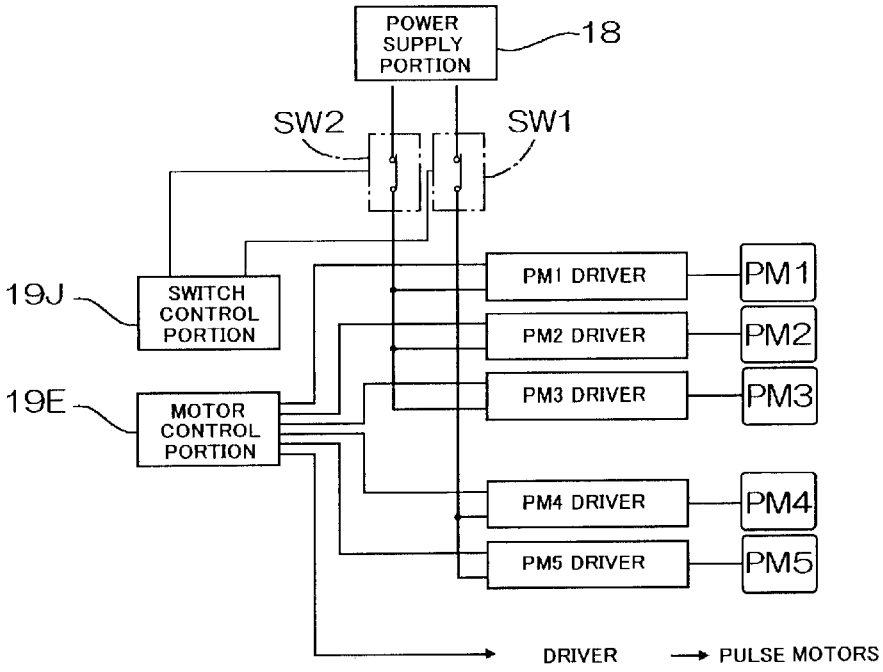
FIG. 5 is block wiring diagram showing wiring among a power supplying portion, the control portion and a main pulse motor of the printing apparatus of the embodiment.

As shown in FIG. 5, the motor control portion 19E is connected to drivers of pulse motors including the pulse motors PM1 to PM5. The respective drivers of the pulse motors PM1, PM2 and PM3 for performing transportation of the intermediate transfer sheet F and image forming to the intermediate transfer sheet F in the image forming portion 9 are connected to the power supply portion 18 via a switch SW2. Also, the respective drivers of the pulse motors PM4 and PM5 for performing transportation of the card C and image forming to the card C in the image forming portion 9 are connected to the power supply portion 18 via a switch SW1. The switches SW1 and SW2 are connected to the switch control portion 19J. Such a switch as the switches SW1 and SW2 may be constituted by two FETs and a plurality of resistors, for example, as well known as an analog switch. The respective switches SW1 and SW2 are turned on by outputting a high level signal to the gates of the FETs from the switch control portion 19J, while the respective switches SW1 and SW2 are turned off by outputting a low level signal to the gates of the FETs therefrom. Incidentally, at a time when the printing apparatus 1 is powered on, setting is made such that both the switches SW1 and SW2 are turned on.

(Operation)

Next, operation of the printing apparatus 1 of the embodiment will be explained mainly with the CPU of the microcomputer 19A of the control portion 19. Incidentally, image information received from an external computer via the external input/output interface 19F and the buffer memory 19G has been stored in the RAM in advance, and it is possible to input the kind of the card C (for example, an ID card, an IC card or the like) or the kind of the intermediate transfer sheet F from the touch panel 8. However, for simplification of explanation, it is assumed that such kinds have been input from the external computer.

When the CPU stores the image information received from the external computer in the RAM, a regular/mirror data producing routine for producing regular image data and mirror image data which are print information of the thermal head 20.

Figure 6:
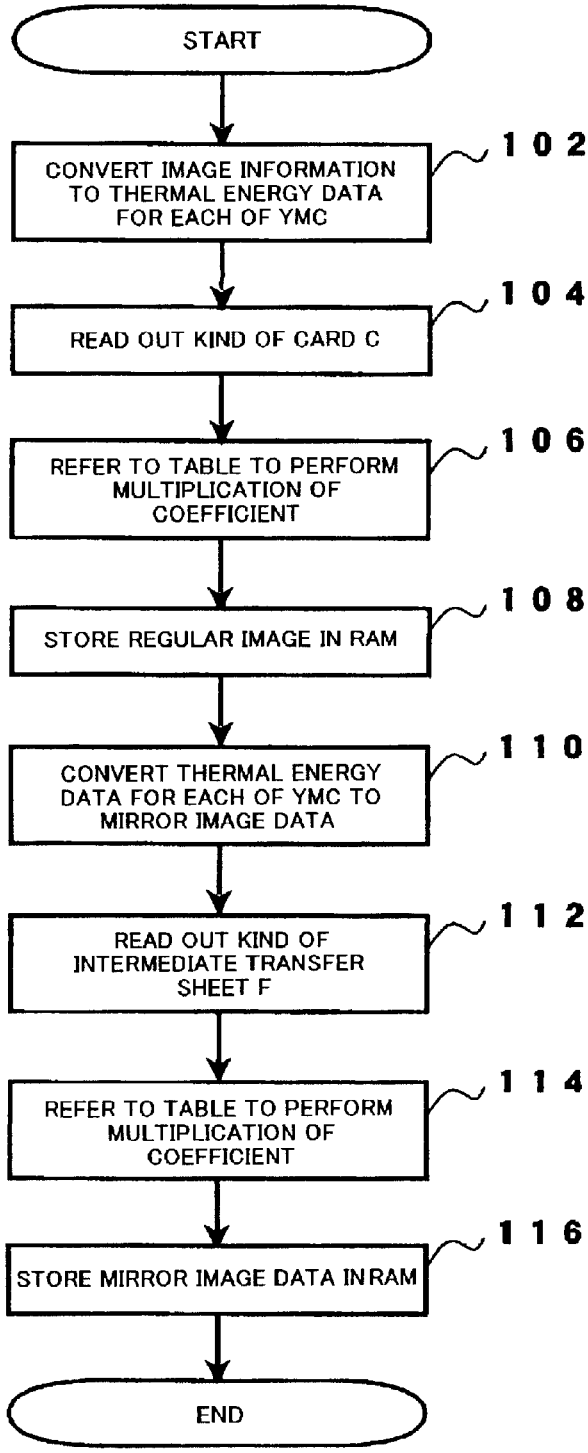
FIG. 6 is a flow chart of a regular image and mirror image data creating routine which a CPU of the control portion of the printing apparatus of the embodiment executes.

As shown in FIG. 6, in the regular image/mirror image producing routine, first, in step 102, the image information which has been stored in the RAM is read out, it is decomposed for each of YMC colors to convert the imaged information (printing data) into thermal energy data. Next, in step 104, the kind of the card is read out, and in step 106, a table showing a relationship between the kind of the card C or the intermediate transfer sheet F described later and their coefficients is read out and a coefficient to be multiplied to the thermal energy to the thermal energy data obtained in step 102 is obtained so that the regular image data is produced for each of YMC colors by multiplying the thermal energy data for each of YMC color by the coefficient. In next step 108, the regular image data produced is stored in the RAM.

In next step 110, the regular image data produced in step 106 is converted into mirror image data. Next, in step 112, the kind of the intermediate transfer data F is read out, the table described above is read out in step 114, the coefficient to be multiplied to the mirror data image obtained in step 110 is obtained according to the kind of the intermediate transfer sheet F, and the mirror image data for each of YMC colors is multiplied by the coefficient, thereby producing the mirror image data for each of YMC colors. In next step 116, the mirror image data is stored in the RAM, and the regular image/mirror image data producing routine is terminated.

Incidentally, in the table described above, since the specific heat of the base film Fa itself of the intermediate transfer sheet F is smaller than that of the card C, the coefficients have been set such that the thermal energy applied to the thermal head 20 from the mirror image data at a time of image forming to the intermediate transfer sheet F becomes smaller than the thermal energy applied to the thermal head 20 from the regular image data at a time of direct transfer to the card C (the thermal energy is larger than that at the time of direct transfer to the card C).

Also, the CPU causes the touch panel 8 to display an initial screen thereon via the touch panel display and operation control portion 19C, and it is put in a standby state until processing information is input about whether a simplex printing or a duplex printing is performed on the card C, whether the direct printing and/or the indirect printing or both of them is performed, which item of the image information is applied in the case. At this time, a mode setting button for setting one of simplex printing, duplex printing, direct printing and indirect printing, a mode clear button for clearing the mode set, a start button for starting printing in a mode set in the printing apparatus 1, a change button described later, information about a standby state or a print enabling state of the printing apparatus 1, the number of printed cards and the like are displayed on the touch panel 8 (or a display screen of the external computer) In explanation given below, when an operator sets the simplex printing by the mode setting button, operation of the printing apparatus 1 will be explained with an example of an image forming routine executed by the CPU.

Figure 7:
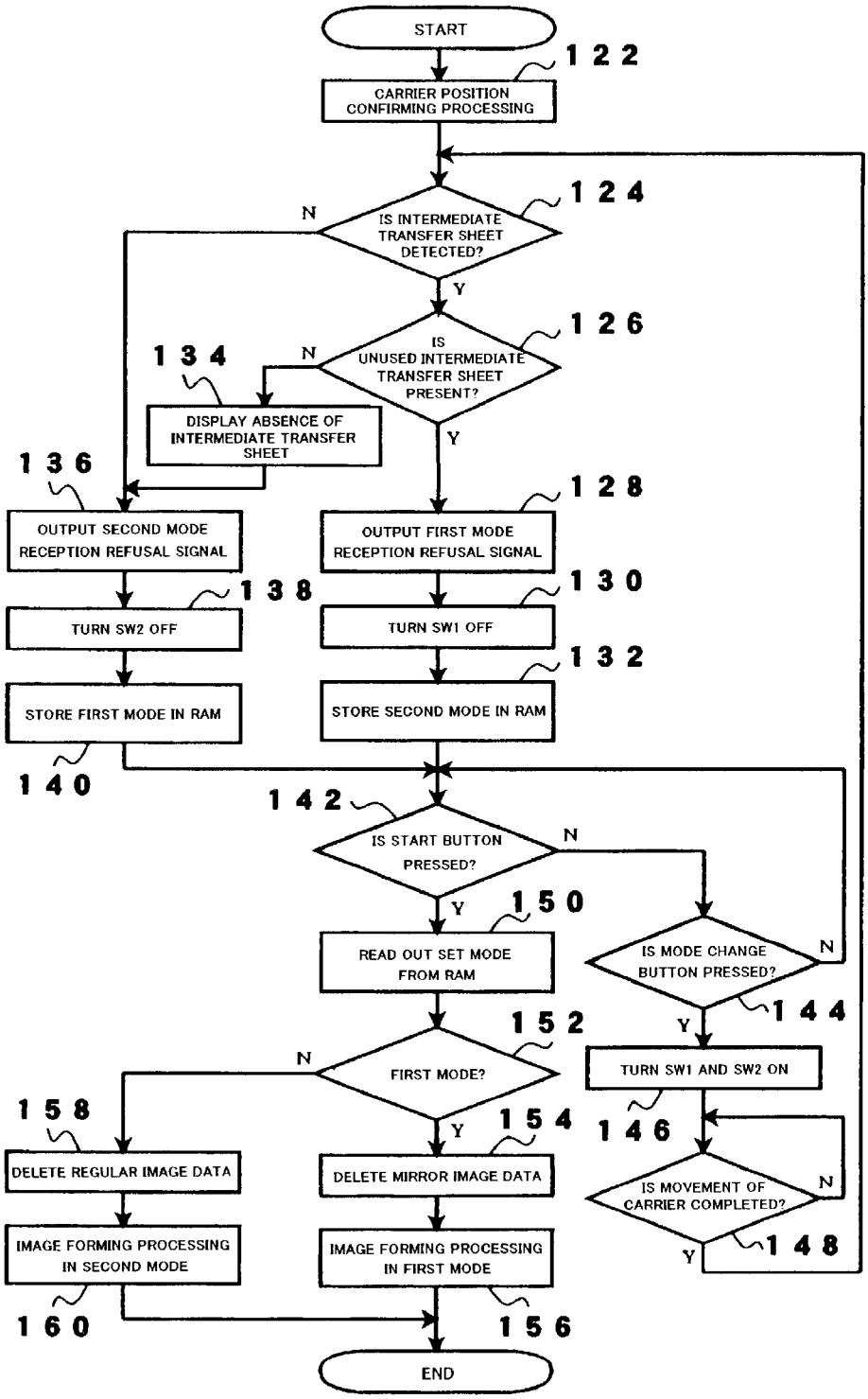
FIG. 7 is a flow chart of image forming routine the CPU of the control portion of the printing apparatus of the embodiment executes.

As shown in FIG. 7, in the image forming routine, in step 122, a carrier position confirming processing for confirming the positions of the carriers 6*a* and 6*b* from outputs of the unitized type reflection sensors S1, S2 and S3 is performed. In the carrier position confirming processing, since the carrier 6*b* is positioned at the retracted position as an initial position, a high level signal should be output from the unitized type reflection sensor S3. However, when the high level signal is not output from the unitized type reflection sensor S3, a message indicating abnormality of the position of the carrier 6*b* is displayed on the touch panel 8. On the other hand, since the carrier 6*a* is positioned at the image forming position or the retracted position as an initial position, confirmation is made from the outputs of the unitized type reflection sensors S1 and S2 about whether the carrier 6*a* is positioned at the image forming position or the retracted position. When any high level signal is not output from both the unitized type reflection sensors S1 and S2, a message indicating abnormality of the position of the carrier 6*a* is displayed on the touch panel 8.

In next step 124, the intermediate transfer sheet F is transported by a predetermined length by forward rotating the pulse motor PM1, and determination is made by monitoring an output signal from the light receiving element Sb about whether or not the intermediate transfer sheet F is positioned at the image forming position. As shown in FIG. 2A, since Y, M, C, Bk and T are formed on the intermediate transfer sheet F in this order, when the carrier 6*a* is positioned at the image forming position, high level signals are outputted from the light emitting element Sb at the positions of Y, M, C and T of the intermediate transfer sheet F, while light emitted from the light emitting element Sa is blocked at the position of Bk (black). Accordingly, since it is found by monitoring output from the light receiving element Sb for a predetermined period that the high level signal and the lower level signal are present in a mixed manner, presence of the intermediate transfer sheet F can be detected.

When negative determination is made in step 124, the routine advances to step 136, where determination about presence/absence of the intermediate transfer sheet F is made by monitoring an output signal from the unitized type transmission Sensor Sc detecting the amount of rotation of the intermediate transfer sheet supplying spool 96. When the unused portion of the intermediate transfer sheet F is wound on the intermediate transfer sheet supplying spool 96, the torque management is performed in the relationship of the platen roller 21*a*>the transport roller 58>the intermediate transfer sheet supplying spool 96, as described above. For this reason, when there is not the unused portion of the intermediate transfer sheet F, the intermediate transfer sheet supplying spool 96 rotates at a high speed, but when there is the unused portion thereof, it rotates at a low speed, so that presence/absence of the unused portion of the intermediate transfer sheet F loaded on the intermediate transfer sheet supplying spool 96 cab be detected.

When negative determination is made in step 126, a message indicating that the unused portion of the intermediate transfer sheet F is not loaded to the intermediate transfer sheet supplying spool 96 is displayed on the touch panel 8 in step 134 and the routine advances to the step 136. When affirmative determination is made in step 126, in step 128, after the intermediate transfer sheet F which has been transported for detection is rewound by a predetermined length by reversely driving the pulse motor PM1, the reverse rotation of the pulse motor PM1 is stopped and a first mode acceptance refusing signal for refusing acceptance of the first mode for performing image forming on the card C through the direct transfer is outputted on the touch panel 8 via the touch panel display and operation control portion 19C. By receiving this signal, the touch panel 8 puts the mode button display of the first mode in a hidden state from the display screen (stops display) and it is put in state that, even when an operator touches the displayed portion, operation instruction of the operator is not taken in, and therefore in a state that the mode button of the second mode performing image forming on the card C by an indirect transfer has been selected.

Next, in steps 130, the switch SW1 which has been turned on is turned off. Thereby, since power supplying from the power supply portion 18 to the pulse motors PM4 and PM5 is interrupted, the motors are made disable. In next step 132, assuming that the second mode has been set by an operator, the default value is stored in the RAM and the routine advances to step 142.

On the other hand, when negative determination is made in step 124, a second mode acceptance refusing signal for refusing acceptance of the second mode described above is outputted to the touch panel 8. By receiving this signal, the touch panel 8 puts the mode button of the second mode in s hidden state from the display screen, and it is put in state that, even when an operator touches the displayed portion, operation instruction of the operator is not taken in, and therefore in a state that the mode button of the first mode has been selected. Next, in step 138, the switch SW2 which has been turned on is turned off. Thereby, since power supplying to the pulse motors PM1, PM2 and PM3 from the power supply portion 18 is interrupted, the motors are made disable. In next step 140, assuming that the first mode has been set by an operator, the default value is stored in the RAM and the routine advances to step 142.

In step 142, determination is made about whether or not the start button on the touch panel 8 has been pressed (touched), and when negative determination is made, determination is made in step 144 whether or not the mode change button for changing the mode from the first mode to the second mode or from the second mode to the first mode has been pressed. When negative determination is made in step 144, the routine returns back to step 142. When affirmative determination is made in step 144, both the switches SW1 and SW2 are turned on again to move the carrier 6*a*. That is, when the second mode is set in step 132, the carrier 6*a* is positioned in the image forming position shown in FIG. 1, but, when the operator presses the mode change button, the carrier 6*a* is moved to the retracted position shown in FIG. 8A by forward drive of the pulse motor PM2. On the contrary, when the first mode is set in step 140, the carrier 6*a* is positioned in the retracted position shown in FIG. 8A, but, when the operator presses the mode change button, the carrier 6*a* is moved to the image forming position shown in FIG. 1 by reverse drive of the pulse motor PM2. During this movement, the pulse motor PM1 is forwardly driven or reversely driven to rotate the intermediate transfer sheet supplying spool 96 in a clockwise or counterclockwise direction with a predetermined torque to transport (feed or rewind) the intermediate transfer sheet F, thereby preventing occurrence of abnormal slack in the section of the intermediate transfer sheet F which extends from the back tension roller 88 to the intermediate transfer sheet supply portion 16 via the platen roller 6*a* and the transport roller 58 or preventing abnormal tension from acting on the intermediate transfer sheet F. Next, in step 148, a standby state is maintained until pulses of a predetermined number are sent to the pulse motor PM2 from the driver for the pulse motor PM2 and movement of the carrier 6*a* is completed. When the movement of the carrier 6*a* is completed, the routine returns back to step 124.

On the other hand, when affirmative determination is made in step 142, the set mode stored in the RAM in step 132 or step 140 is read out in step 150, and determination is made in step next 152 about whether or not the set mode read out is the first mode. When affirmative determination is made, after the mirror image data stored in the RAM in step 116 of the regular image/mirror image data producing routine is deleted in next step 154, an image forming processing in the first mode described later is performed in step 156 to terminate the image forming routine. When negative determination is made in step 152, after the regular image data stored in the RAM in step 108 of the regular image/mirror image data producing routine is deleted in step 158, an image forming processing in the second mode described later is performed in next step 160 to terminate the image forming routine.

[Image Forming Processing According to First Mode]

The CPU actuates respective rollers in the card supply portion 3, the cleaner 4 and turning portion 5 which are disposed on the second card transport path P2 to transport the card C in the card supply portion 3 in the direction of arrow L and cause the pinch rollers 38 and 39 of the turning portion 5 to nip the card C. That is, the bottommost card C in the card stacker is fed to the second card transport path P2 according to rotation of the kick roller 31 in the card supply portion 3, and both surfaces thereof are cleaned by the cleaning roller 34 in the cleaner 4. When a leading edge of the card C is detected by the unitized type transmission sensor S5 (not shown) disposed between the cleaner 4 and the turning portion 5, the rotation of the kick roller 31 in the card supply portion 3 is stopped. The card C is stopped (the rotational drive of the pinch rollers 38 and 39 is also stopped) after it is transported by a predetermined number of pulses from the unitized type sensor to the turning portion 5, and the turning portion 5 put in a horizontal state is put in a state of nipping the card C.

Next, the turning portion 5 is turned by an angle of 90° to be made in a vertical attitude (refer to a double dotted line in FIG. 1) so as to be capable of transport the card C in the direction of arrow U on the first card transport path P1, the pinch rollers 38 and 39 is rotationally driven and the capstan rollers 74 and 78 and the platen roller 21*b* in the carrier 6*b* are rotationally driven by the pulse motor PM5, so that transport of the card C in the direction of the image forming portion 9 along the first card transport portion P1 is started.

Next, determination about whether or not a trailing edge of the card C has been transported up to a predetermined position is made according to a signal from the unitized type transmission sensor S6 (not shown) disposed between the turning portion 5 and the carrier 6*b* positioned in the retracted position. When negative determination is made, the transport of the card C in the direction of arrow U continues. When affirmative determination is made, driving of the pinch rollers 38 and 39 and the pulse motor PM5 in the turning portion 5 is stopped after the card C is transported by a distance corresponding to the predetermined number of pulses. Thereby, the card C is put in a state that its both ends are nipped by the upper roller pair and the lower roller pair in the carrier 6*b* positioned in the retracted position.

Next, the pulse motor PM4 is driven to move the carrier 6*b* nipping the card C from the retracted position to the image forming position. Then, the pulse motor PM5 is driven to transport the card C in the direction of arrow D (state shown in FIG. 8B) until the leading edge of the card C reaches the above-described image forming position (printing start position) in the narrow sense. During this time, the thermal head 20 is positioned so as to be separated from the platen roller 21*b*, and the thermal transfer sheet R is fed by a predetermined length until a starting end of Y is positioned at a printing position Sr. Such a control can be performed by detecting the rear end of Bk (black) of the thermal transfer sheet R by the light receiving element disposed between the guide rolls 53 and then detecting rotation of the clock plate disposed in the vicinity of the take-up roller pair 57 by a unitized type transmission sensor to measure the distance from a rear end of Bk (black) to a start end of Y (yellow), these widths being defined on the thermal transfer sheet R in equal intervals. Next, rotational operation of the thermal head advancing/retracting cam 23 in the advancing/retracting drive unit starts. At this time, one surface of the card C is supported by the platen roller 21*b* while the other surface thereof is pressed onto the thermal head 20 via the thermal transfer sheet R.

Then, a thermal transfer of the ink layer on the thermal transfer sheet R, namely a direct transfer, is performed to the one surface of the card C by the thermal head 20. Incidentally, the CPU feeds regular image data for each of YMC colors, which has been stored in the RAM in step 108, to the thermal head 20 via the thermal head control portion 19H. In the image forming in the first mode, the thermal head 20 is heated according to the regular image data.

This image forming operation will be explained in detail below. The platen roller 21*b* is rotated in the counterclockwise direction and the thermal transfer sheet R is taken up on the thermal transfer sheet taking-up portion 15 in synchronism therewith so that image forming (printing) of Y (yellow) is performed on the card C by the direct transfer (the state shown in FIG. 9A). When the image forming of Y (yellow) is completed, the thermal head advancing/retracting cam 23 is rotated reversely to the direction of arrow A to retract the thermal head 20 from the card C. After the thermal head 20 is retracted, reverse rotation of the pulse motor PM5 (not shown) is started to position the leading edge of the card C in the image forming position again and the reverse rotation of the pulse motor PM5 (not shown) is stopped.

During this period, the CPU feeds the thermal transfer sheet R by a slight amount until the leading edge of the next M (magenta) is positioned at the printing position Sr. Then, by rotating the thermal head advancing/retracting cam 23 in the direction of arrow A, the thermal head 20 is pushed on to the card C via the thermal transfer sheet R to form an image of M (magenta) on the card C in superimposition on the image of Y (yellow). The CPU repeats the above processing sequentially to form images in superimposing manner on the back surface of the card C with inks of YMC colors. Incidentally, in many cases, printing on the back surface of the card C is generally performed with one color of Bk (black) designated. In such a case, an image forming is performed with only Bk (black) and an image forming using the colors of YMC is not performed. When the direct transfer to the card C is terminated, the CPU rotates the thermal head advancing/retracting cam 23 reversely to the direction of arrow A to retract the thermal head 20 from the card C.

Since the card C has not been nipped by the lower roller pair just after the image forming on the card C is performed by the image forming portion 9, the pulse motor PM5 is reversely driven by a predetermined number of pulses until both ends of the card C are nipped by the upper roller pair and the lower roller pair. Next, the pulse motor PM4 is reversely rotated to move the carrier 6*b* nipping the card C from the image forming position to the retracted position. Confirmation about whether or not the carrier 6*b* has been positioned in the retracted position can be made from the output of the unitized type sensor S3. Subsequently, the pinch rollers 38 and 39 in the turning portion 5 are reversed and the pulse motor PM5 is reversely driven again to reverse the upper roller pair and the lower roller pair, thereby transporting the card C in the direction of arrow D.

Next, determination about whether or not the tailing edge of the card C has been transported to the predetermined position is made according to a signal from the unitized type transmission sensor S6 (not shown) disposed between the turning portion 5 and the carrier 6*b* positioned in the retracted position. When negative determination is made, the transport of the card C in the direction of arrow D continues. When affirmative determination is made, the card C is further transported in the direction of arrow D by a distance corresponding to a predetermined number of pulses, the reverse driving of the pulse motor PM5 is stopped and the reversing of the pinch rollers 38 and 39 are stopped, thereby causing the pinch rollers 38 and 39 of the turning portion 5 to nip the card C. Next, the turning portion 5 which remains as nipping the card C in a vertical state so as to be capable of transport the card C in the direction of arrow L is turned by an angle of 90°. Thereby, a surface of the card C on which an image forming has not been performed is positioned on the second card transport path P2 with the surface directed upwardly.

The CPU rotationally drives the pinch rollers 38 and 39 of the turning portion 5 and the pulse motor PM6 (not shown) to transport the card C on the second card transport path P2 in the direction of arrow L and discharge it in the stacker 13 via the discharge port 27. When the CPU receives a signal from a unitized type transmission sensor S9 (not shown) disposed between the horizontal transport portion 12 and the discharge port 27, the roller drive on the second transport path p2 is stopped after a predetermined time elapses, and the number of cards processed or a completion of processing is displayed on the touch panel 8. The simplex direct printing is performed on the subsequent cards C until processing of the number of cards inputted from the touch panel 8 is completed. Incidentally, in the image forming processing according to the first mode, as shown in FIG. 1, the heat roller 45 is maintained in a separated state from the platen roller 50.

[Image Forming Processing According to Second Mode]

In the image forming processing according to the second mode, first, by heating the ink layer of the intermediate transfer sheet F by the thermal head 20, an image is formed on the receptive layer Fe of the intermediate transfer sheet F. Image forming is performed by rotationally driving the pulse motor PM3 to rotate the platen roller 21*a* in the counterclockwise direction and rotationally driving the pulse motor PM 1 to take up the intermediate transfer sheet F on the intermediate transfer sheet supply portion 16, and taking up the thermal transfer sheet R on the thermal transfer sheet taking-up portion 15 in synchronism therewith.

This operation will be described in detail below. The mark for positioning formed on the intermediate transfer sheet F is recognized by monitoring an output of the light emitting device Sb, the rotation amount of the clock plate connected to the back tension roller 88 which is always rotated forwardly and reversely in unity with feeding and returning of the intermediate transfer sheet F is monitored by a unitized type transmission sensor (not shown), and the intermediate transfer sheet F is transported to the image forming position in a narrow sense by a predetermined length. The thermal head 20 is put in a position separated from the platen roller 21*a* and the thermal transfer sheet R is transported by a predetermined length, for example, until a start end of Y (yellow) is positioned at the printing position Sr, as described above. When the start end of Y (yellow) reaches the printing position Sr, the CPU rotates the thermal head advancing/retracting cam 23 in the direction of arrow A to press the thermal head 20 on to the platen roller 21*a* via the thermal transfer sheet R and simultaneously rotationally drives the pulse motors PM1 and PM3 to rotate the platen roller 21*a* in the counterclockwise direction, thereby rewinding the intermediate transfer sheet F at the same speed as that of the thermal transfer sheet R. Thereby, the image forming of Y (yellow) is performed on the intermediate transfer sheet F (the state shown in FIG. 9B). Incidentally, the CPU causes mirror data for each of YMC colors which has been stored in the RAM in step 116 to be fed to the thermal head 20 via the thermal head control portion 19H in advance. In the image forming according to the second mode, the thermal head 20 is heated according to the mirror data.

When the image forming of Y (yellow) on the intermediate transfer sheet F is completed, the CPU rotates the thermal head advancing/retracting cam 23 to retract the thermal head 20 relative to the platen roller 21*a* and revesely rotates the pulse motor PM1 to transport the intermediate transfer sheet F until the mark for positioning formed on the intermediate transfer sheet F passes through the light emitting device Sb.

Next, like the case of the image forming of Y (yellow), the mark for positioning formed on the intermediate transfer sheet F is recognized by monitoring a light emitting device (not shown), the rotation amount of the clock plate connected to the back tension roller 88 which is always rotated forwardly and revesely in unity with feeding and returning of the intermediate transfer sheet F is monitored by a unitized type transmission sensor (not shown), and the intermediate transfer sheet F is transported to the image forming position in a narrow sense by a predetermined distance. The thermal transfer sheet R is slightly fed until a leading end of the next M (magenta) is positioned at the printing position Sr. Then, like the case of Y (yellow), the thermal head advancing/retracting cam 23 is rotated again to press the thermal head 20, thereby performing image forming of M (magenta) on the receptive layer Fe of the thermal transfer sheet R in superimposition on Y (yellow). The CPU sequentially repeats the above processings, and after images are formed in a superimposing manner on the intermediate transfer sheet F with dyes of YMC colors, the thermal head 20 is retracted relative to the platen roller 21*a*.

Next, the intermediate transfer sheet F is transported to the position of the heat roller 45 which has been separated from the platen roller 50 in advance according to the rotation amount of the clock plate connected to the back tension roller 88. The mark for positioning of the intermediate transfer sheet F is detected by monitoring an output from a light receiving device arranged between the guide roll 44 and the guide plate 47 within the transport portion 10 during this transport, and the transport amount of the intermediate transfer sheet can be reset at this time, so that a transport accuracy is improved. Also, like the case of image forming according to the first mode described above, the respective rollers in the card supply portion 3, the cleaner 4 and the turning portion 5 are driven during transport of the intermediate transfer sheet F to the transfer portion 10, and driving of the rollers is stopped in a state where the card C is nipped in the turning portion 5 maintained horizontally. Thereafter, the turning portion 5 is rotated (inverted) at an angle of 180° to turn over the card C relative to the second card transport path P2, so that the card C is further transported on the second card transport path P2 from the turning portion 5 in the direction of arrow L by rotationally driving the pinch rollers 38 and 39 and the pulse motor PM6 (not shown). When a unitized type transmission sensor S7 disposed in the vicinity of the transport roller pair 48 on the side of the horizontally transporting roller pair 11 detects the leading edge of the card C, the card C is further transported in the direction of arrow L by a distance corresponding to a predetermined number of pulses. Thereby, the card C is transported until its leading end is brought into contact with the heat roller 45.

Next, the state where the heat roller 45 has been separated from the platen roller 50 (refer to FIG. 1) is translated to the state where the former comes into contact with the latter (refer to FIG. 3) by rotating the heat roller ascending/descending cam 51 in the direction of arrow B, rotational drive of the heat roller ascending/descending cam 51 is stopped. At this time, the back face of the leading edge of the card C is supported the platen roller 50 and the surface thereof is pressed on to the heat roller 45 via the intermediate transfer sheet F.

Subsequently, an indirect transfer for thermally transferring an image formed on the receptive layer Fe of the intermediate transfer sheet F on the surface of the card C by the heat roller 45 in the image forming portion 9 is performed. The operation of image forming (transferring) in the transfer portion 10 will be explained in detail below. One face of the card C is supported by the platen roller 50 rotating in the counterclockwise direction and the surface thereof is pressed on the heat roller 45 via the intermediate transfer sheet F so that the card C is transported in the direction of arrow L. The peeling-off Fc of the intermediate transfer sheet F is peeled off from the base film Fa by heat of the heat generating lamp 46, and the receptive layer Fe on which the image has been formed and the overcoat layer Fd are transferred in a unitized manner on the other face of the card C. the intermediate transfer sheet F is taken upon the take-up portion 17 in synchronism with the transfer. Whether or not the intermediate transfer has been completed is determined by monitoring an output from a unitized type transmission sensor S8 disposed in the vicinity of a roller pair disposed between the transport roller pair 61 and the discharge roller pair on the side of the discharge roller pair. When the indirect transfer has not been completed yet, the indirect transfer continues, but when the indirect transfer has been completed, the transport of the intermediate transfer sheet F (taking-up to the intermediate transfer sheet take-up portion 17) is stopped and the heat roller ascending/descending cam 51 is rotated again to retract the heat roller 45 relative to the platen roller 50. Incidentally, the transport speeds of the card C and the intermediate transfer sheet F during transferring are made equal to each other.

When the image forming in the transfer portion 10 has been completed, a standby state is maintained until a trailing end of a card C is detected based on an output from the unitized type transmission sensor S9 disposed between the horizontally transporting portion 12 and the discharge port 27. When the tailing end of the card C is detected, the roller driving on the second card transport path P2 is stopped after a predetermined time elapses, and the number of cards processed or the completion of the processing is displayed on the touch panel 8. The card C passes through the horizontally transporting portion 12 to be discharged into the stacker 13 via the discharge port 27.

(Operation and the Like)

Next, operation of the printing apparatus 1 of this embodiment and the like will be explained.

Since the printing apparatus 1 of this embodiment has the image forming portion 9 which forms an image on the card C or the intermediate transfer sheet F and the transfer portion 10 which transfers an image formed on the intermediate transfer sheet F on the card C, printing according to both the direct transfer and the indirect transfer can be performed.

Also, in the printing apparatus 1 of this embodiment, when the light emitting device Sb detects the intermediate transfer sheet F in the image forming position (step 124), the touch panel 8 refuses accepting an input of the first mode by outputting a acceptance rejecting signal of the first mode which forms an image on the card C in the direct transfer (step 128) and further turns off the switch SW1 to the drivers of the pulse motors PM4 and PM5 which are driving sources for the first mode to make the first mode disable (step 130). On the other hand, when the light receiving device Sb does not detect the intermediate transfer sheet F in the image forming position (step 124) or when an unused portion of the intermediate transfer sheet F has not been wound on the intermediate transfer sheet supplying spool 96 (step 126), the touch panel 8 refuses accepting an input of the second mode from an operator by outputting an acceptance refusing signal of the second mode which forms an image on the intermediate transfer sheet F (step 136) and further turns off the switch SW2 to the motor drivers of the pulse motors PM1, PM2 and PM3 which are driving sources for the second mode to make the second mode disable (step 138). Accordingly, in the printing apparatus 1, since, when one of the mode is set, the other mode is inhibited from being set, for example, when the second mode is set, power is not supplied to the pulse motor PM4 so that such a mechanical error or drawback can be reduced that the card C is erroneously transported, entangling or catching of the intermediate transfer sheet F inside the casing 2 occurs due to the complicated mechanism and so on. A print processing capability inherent in the printing apparatus 1 such as a processing speed per a predetermined number of cards can be improved by reducing such an error or drawback. In addition, when one mode is set (selected), the other mode is not only inhibited or disabled, but also a translation from setting one mode to the other mode can be performed by pressing the mode change button on the touch panel 8 (steps 144 to 148), so that a possibility that an operator performs image forming in his/her unintended mode erroneously can be reduced.

Further, in the printing apparatus 1 of this embodiment, when one mode is set, print information (regular image data, mirror image data) used in the other mode is deleted, and feeding of the print information from the thermal head control portion 19H to the thermal head 20 is inhibited in advance, so that the reliability of the printing apparatus 1 can be prevented from lowering beforehand.

Figure 10:
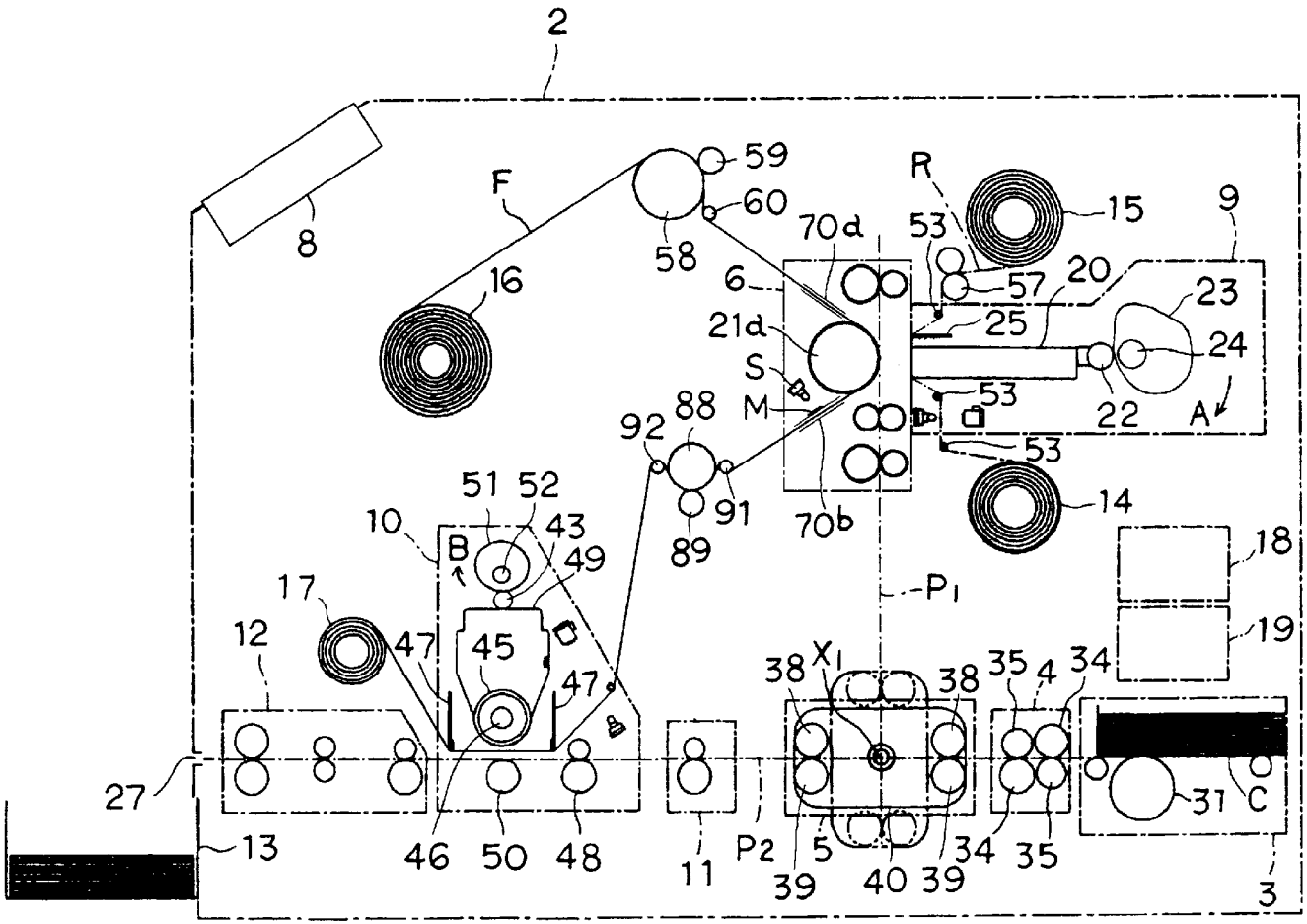
FIG. 10 is a front view of a schematic configuration of a printing apparatus of another embodiment of the present invention.

Incidentally, in this embodiment, as the aspect where image forming to the card C or the intermediate transfer sheet F is inhibited or disabled, such an aspect has been disclosed that the carrier 6*a* is moved in the X direction and the carrier 6*b* is moved in the Y direction, but the present invention is not limited to this aspect. For example, such a configuration can be employed in this invention that both the carriers 6*a* and 6*b* are moved in the Y direction (arrow U direction or arrow D direction). In this case, a guide roll 81 on which the intermediate transfer sheet F is entrained above the platen roller 21*a* according to movement of the carrier 6*a* in the Y direction (arrow U direction) is disposed so that entangling of the intermediate transfer sheet F transported in the reverse direction on the basis of the platen roller 21*a* or catching thereof in the platen roller 21*a* can be prevented. Also, as the aspect that the intermediate transfer sheet F is retracted, a printing apparatus shown in FIG. 10 is provided on both side in the vicinity of the platen roller 21*a* and at a position opposed to the thermal head 20 with intermediate transfer sheet holding members with a U-shaped sectional configuration 70*a* and 70*b* each holding the intermediate transfer sheet F and having an opening at either one of an upper direction or an lower direction. A mirror M is fixed to one of the intermediate transfer sheet holding members 70*a* and 70*b*, and a unitized type reflection sensor S is disposed at a position corresponding to the mirror M. When intermediate transfer is not performed, the intermediate transfer sheet holding members 70*a* and 70*b* are retracted in an upward direction or a downward direction (Z direction) on the drawing on which FIG. 9 is shown (which is separated from the platen roller 21*a*). When intermediate transfer is performed, the intermediate transfer sheet F is brought into contact with the platen roller 21*a* and put in the image forming position by descending or ascending the intermediate transfer sheet holding members 70*a* and 70*b* in synchronism with each other. The unitized type reflection sensor S detects the fact that image forming can be conducted by the intermediate transfer sheet F on the basis of the contact. Accordingly, not only the aspect of performing direct detection of the intermediate transfer sheet F shown in the above embodiment but also an aspect of performing indirect detection are included in the technical scope of the present invention. Also, the intermediate transfer sheet supply portion 16 performs transport (feeding and rewinding) of the intermediate transfer sheet F according to movement of the intermediate transfer sheet holding members 70*a* and 70*b* in the Z direction. It is preferable that the length of each of the intermediate transfer sheet holding members 70*a* and 70*b* is longer than the length of the intermediate transfer sheet F coming in contact with the periphery of the platen roller 21 so as not to apply extra tension to the intermediate transfer sheet F. incidentally, in the printing apparatus of this aspect, the platen roller 21*a*, the capstan roller and the like are positioned at fixed image forming positions.

Further, in this embodiment, such a configuration has been shown that the upper roller pair, the lower roller pair and idle roller pair disposed between the platen roller 21*b* and the lower roller pair are moved along with carrier 6*b*, but such a configuration can, of course, be employed in this invention that the intermediate transfer sheet F is retracted from the image forming position to inhibit the intermediate transfer by fixing these roller pairs and moving only the platen roller 21*a* in the X direction. Also, in this embodiment, the configuration that the carriers 6*a* and 6*b* are moved between the image forming positions and the retracted positions by the rack and pinion structure has been shown, but movement with a high position accuracy can securely be achieved even when a linear pulse motor is used instead of the rack and pinion structure.

Further, in this embodiment, the structure that image forming is performed on one surface of the card C by the direct transfer or the indirect transfer has been shown, but such a structure can of course be employed that, after an image forming processing in the first mode has been performed, the card C is turned or rotated at 90° in the turning portion 5 and an image forming processing is performed according to the second mode so that image forming can be performed on both surfaces of the card C. Moreover, in the printing apparatus 1 of this embodiment, since a card C can be nipped and transported between the transport roller pair 48 and the horizontally transporting roller pair 11, and another card C can be nipped in the turning portion 5, a printing processing can be performed in a state that a card C which is subjected to image forming in the image forming portion 9 is different from a card C which is subjected to image forming in the transfer portion 10.

In this embodiment, such a structure where only one image forming portion 9 is provided has been shown, but a plurality of (for example, two) image forming portions 9 can be provided in this invention. When such a configuration is employed, since image forming is performed on the card C in one image forming portion while an image is formed on the intermediate transfer sheet F in another image forming portion, an error such as an entangle of the intermediate sheet or the like can be reduced, and the printing speed can be improved.

What is claimed is:

1. A printing apparatus, comprising:

at least one printing unit which selectively forms an image on a recording medium and an intermediate transfer medium which temporarily saves an image thereon;

a transfer unit which transfers the image formed on the intermediate transfer medium to the recording medium;

an intermediate transfer medium detecting unit which detects the intermediate transfer medium;

a mode setting unit which sets one of a first mode for forming an image on the recording medium by the at least one printing unit and a second mode for forming an image on the intermediate transfer medium; and a mode control unit which causes the at least one printing unit to perform image forming in one of the first and second modes set by the mode setting unit, wherein the mode control unit inhibits execution of image forming in the first mode when the intermediate transfer medium detecting unit detects the intermediate transfer medium.

2. A printing apparatus according to claim 1, wherein the at least one printing unit has printing elements for forming an image on the recording medium or the intermediate transfer medium according to print information supplied from the mode control unit, and the mode control unit inhibits sending of the print information according to the first mode to the printing elements when the intermediate transfer medium detecting unit detects the intermediate transfer medium.

3. A printing apparatus according to claim 1, further comprising a recording medium transporting unit which reciprocates the recording medium relative to the at least one printing unit; and a recording medium transport driving unit which drives the recording medium transporting unit, wherein the mode control unit inhibits drive of the recording medium transport driving unit when the intermediate transfer medium detecting unit detects the intermediate transfer medium.

4. A printing apparatus according to claim 1, wherein the mode control unit causes the mode setting unit to refuse acceptance of the first mode when the intermediate transfer medium detecting unit detects the intermediate transfer medium.

5. A printing apparatus according to claim 1, wherein the intermediate transfer medium detecting unit is a transmission type sensor disposed in a transport path of the intermediate transfer medium.

6. A printing apparatus according to claim 1, further comprising an intermediate transfer medium supply spool on which an unused portion of the intermediate transfer medium is wound, wherein the intermediate transfer medium detecting unit is an intermediate transfer medium supply spool rotation detecting sensor which detects rotation of the intermediate transfer medium supply spool.

7. A printing apparatus, comprising:

at least one printing unit which selectively forms an image on a recording medium and an intermediate transfer medium which temporarily saves an image thereon;

a transfer unit which transfers the image formed on the intermediate transfer medium to the recording medium;

an intermediate transfer medium detecting unit which detects the intermediate transfer medium;

a mode setting unit which sets one of a first mode for forming an image on the recording medium by the at least one printing unit and a second mode for forming an image on the intermediate transfer medium; and a mode control unit which causes the at least one printing unit to perform image forming in one of the first and second modes set by the mode setting unit, wherein the mode control unit inhibits execution of image forming in the second mode at a time of non-detection of the intermediate transfer medium by the intermediate transfer medium detecting unit.

8. A printing apparatus according to claim 7, wherein the at least one printing unit has printing elements for forming an image on the recording medium or the intermediate transfer medium according to print information supplied from the mode control unit, and the mode control unit inhibits sending of the print information according to the second mode to the printing elements at the time of non-detection of the intermediate transfer medium by the intermediate transfer medium detecting unit.

9. A printing apparatus according to claim 7, wherein the mode control unit causes the mode setting unit to refuse acceptance of the second mode at the time of non-detection of the intermediate transfer medium by the intermediate transfer medium detecting unit.

10. A printing apparatus according to claim 7, wherein the intermediate transfer medium detecting unit is a transmission type sensor disposed in a transport path of the intermediate transfer medium.

11. A printing apparatus according to claim 7, further comprising an intermediate transfer medium supply spool on which an unused portion of the intermediate transfer medium is wound, wherein the intermediate transfer medium detecting unit is an intermediate transfer medium supply spool rotation detecting sensor which detects rotation of the intermediate transfer medium supply spool.

12. A printing method comprising the steps of:

transporting a recording medium and an intermediate transfer medium which temporarily saves an image to an image forming position;

selectively forming an image on the recording medium and on the intermediate transfer medium in the image forming position;

transporting one of the recording medium and a different recording medium to an image transferring position; and transferring the image formed on the intermediate transfer medium in the image transferring position to the recording medium, wherein image forming to either one of the recording medium and the intermediate transfer medium is inhibited in response to a detection signal for detecting the intermediate transfer medium.

13. A printing method comprising the steps of:

transporting a recording medium and an intermediate transfer medium which temporarily saves an image to an image forming position;

selectively forming an image on the recording medium and the intermediate transfer medium in the image forming position;

transporting one of the recording medium and a different recording medium to an image transferring position; and transferring the image formed on the intermediate transfer medium in the image transferring position to the recording medium, wherein transport of the recording medium to the image forming position is inhibited in response to a detection signal which detects the intermediate transfer medium.

* * * * *